United States Patent [19]

Terzian

[11] 4,270,196

[45] May 26, 1981

[54] BALANCED COMPLEMENTARY DIGITAL TIME DISPLAYS

[76] Inventor: Berj A. Terzian, 66 Hirst Rd., Briarcliff Manor, N.Y. 10510

[21] Appl. No.: 17,931

[22] Filed: Mar. 6, 1979

Related U.S. Application Data

[63] Continuation-in-part of Ser. No. 861,115, Dec. 16, 1977, abandoned.

[51] Int. Cl.[3] ..... G04C 19/00

[52] U.S. Cl. ..... 368/82; 368/239; 340/756

[58] Field of Search ..... 368/82–84, 368/239–242; 340/756, 765

[56] References Cited

U.S. PATENT DOCUMENTS

| | | | |
|---|---|---|---|
| 3,576,099 | 4/1971 | Walton | 58/50 R |
| 3,613,351 | 10/1971 | Walton | 58/23 R |
| 3,701,249 | 10/1972 | Berget et al. | 58/50 R |
| 3,722,206 | 3/1973 | Berget | 58/58 |
| 3,760,582 | 9/1973 | Thiess et al. | 58/50 R |
| 3,760,584 | 9/1973 | Dargeht | 58/50 R |
| 3,827,043 | 7/1974 | Maezaua | 58/50 R |
| 3,971,012 | 7/1976 | Morokawa et al. | 58/50 R |
| 4,092,638 | 3/1978 | Ripley | 58/50 R |

FOREIGN PATENT DOCUMENTS

| | | | |
|---|---|---|---|
| 1388127 | 3/1975 | United Kingdom | 58/50 R |
| 1442630 | 7/1976 | United Kingdom | 58/50 R |
| 1475413 | 6/1977 | United Kingdom | 58/50 R |

OTHER PUBLICATIONS

"Die Uhren und Schmuck", 1977, Issue 8, pp. 34–35.

*Primary Examiner*—Vit W. Miska

*Attorney, Agent, or Firm*—Eyre, Mann, Lucas & Just

[57] ABSTRACT

Balanced complementary digital time displays, for readout in a left to right direction, in which (i) during the first half of each successive hour, the principal digit value of the present hour is in a leading position relative to trailing principal minute digit values which increase from zero to thirty, while simultaneously the complementary digit value of the next hour is in a trailing position relative to leading complementary minute digit values which correspondingly decrease from sixty to thirty, and (ii) during the second half of each successive hour, the principal digit value of the next hour is in a trailing position relative to leading principal minute digit values which decrease from twenty-nine to one, while simultaneously the complementary digit value of the present hour is in a leading position relative to trailing complementary minute digit values which correspondingly increase from thirty-one to fifty-nine. Such displays provide immediately comprehendible exact and gross time indications.

43 Claims, 9 Drawing Figures

BALANCED COMPLEMENTARY DIGITAL TIME DISPLAYS

CROSS-REFERENCE TO RELATED APPLICATION

This application is a continuation-in-part of copending application Ser. No. 861,115, filed Dec. 16, 1977, abandoned.

BACKGROUND OF THE INVENTION

1. Field of the Invention

This invention relates to time keeping and, more particularly, to the use of digital time displays for general purpose time keeping. The term "general purpose", as applied to digital time displays or digital time keeping in context of the ensuing description, is used qualitatively to refer to the general time keeping needs and practices of ordinary individuals occupied with their usual activities on a day-to-day basis, as distinguished from specialized time monitoring procedures used in particular circumstances, e.g., scientific experiments, computer operations, games and sporting events, etc.

2. Description of the Prior Art

General purpose digital time displays have been available to consumers over the past several years in a variety of products, e.g. wrist watches, clocks, clock-radios and numerous other articles. Such displays generally consist of a horizontal array of hour and minute digits separated by a colon, with the hour digits positioned to the left and the minute digits to the right, and with the minute digits being driven to count values up from 01 to 59 and, one minute later, to reset to 00, with a simultaneous increase in the value of the hour digits to that of the next hour. On occasion, with liquid crystal type displays, second digits are also provided, positioned to the right of the minute digits and also driven to count seconds up from 01 to 59, with resetting to 00 one second later, when the value of the minute digits is increased to the next minute. In other instances, such as with light emitting diode type displays, switching is employed to display second digits alone, counted as described above but without a simultaneous display of hour and minute digits.

Although such displays and products have been commercially successful, they have not displaced completely, or even to a major extent, their analog counterparts and competition. The latter are based upon the conventional twelve-hour dial face with hour, minute and, optionally, second hands rotating through 360° to indicate the time by the progressive positions of the hands relative to spaced markings applied along the dial perimeter. Many consumers, both prospective and actual, have found currently available general purpose digital time displays to be inconvenient, awkward, difficult to use or otherwise objectionable in comparison to analog time displays, and often because of poorly perceived or definable reasons.

Although it appears to be commonly accepted that conventional general purpose digital time displays excel in informing the user of the present time at the moment of the readout, it is also recognized that burdensome mental calculations are required to translate that readout in the viewer's mind into grosser time contexts, e.g. the position of the precise time relative to a larger interval such as an hour or half hour, or how much time remains before the next hour or half hour, or how much time has passed or is to pass in relation to the occurrence of other exact times as previous or future references. Thus, conventional general purpose digital time displays suffer from the basic drawback of isolating the present time without also providing rapidly comprehendible indications of the larger time contexts which individuals ordinarily rely upon to carry out their general activities and for which analog time displays are far superior because of the graphic overall picture of gross time presented by their hand positions relative to the dial face markings. These and like problems in the use of conventional digital time displays have been described specifically, for example, in a survey reported in the November 1976 issue of Consumer Reports (Vol. 41, No. 11), a well known consumer products evaluation journal.

SUMMARY OF THE INVENTION

Balanced digital time display systems and methods for avoiding or alleviating the above noted problems associated with conventional digital time displays are disclosed in copending application Ser. No. 861,115, filed Dec. 16, 1977, the disclosure of which is incorporated herein by reference as background to the present invention, which provides an improvement to the previous invention.

More particularly, the present invention retains all of the advantages of the previous systems and methods of displaying balanced digital time values and, in addition, enlarges the scope thereof by displaying, preferably simultaneously, complementary balanced digital time values. This achieves a complete definition of the relationship of any current exact time readout to the then expired and remaining parts of the present hour, as well as the approaching next hour. By incorporating primary emphasis in a principal display of minute digits increasing to and decreasing from a peak value of thirty, relative to the present hour and the next hour, respectively, the balanced complementary displays of this invention focus the viewer's attention, over the course of each hour, mainly upon digit values of lowest value and narrowest range to obtain the simplification and advantages described in the previous patent application, while also providing further useful complementary time indications with higher digit values which do not detract from the principal display.

The foregoing is achieved by providing balanced complementary digital time displays, for readout in a left to right direction, in which (i) during an initial part of each successive hour, the principal digit value of the present hour is in a leading position relative to trailing principal minute digits which increase in value, while simultaneously the complementary digit value of the next hour is in a trailing position relative to leading complementary minute digits which correspondingly decrease in value, and (ii) during the subsequent part of the present hour, the principal digit value of the next hour is in a trailing position relative to leading principal minute digits which decrease in value, while simultaneously the complementary digit value of the present hour is in a leading position relative to trailing complementary minute digits which correspondingly increase in value.

In order to achieve maximum balance, comprehendibility and facility in use, it is preferred that the above operating principles be implemented to divide, and thereby distinguish, each successive hour into its equal halves. This means, during the first half hour, positioning the principal digit value of the present hour before principal minute digits which incrementally increase in value from zero to thirty, while simultaneously the complementary digit value of the next hour is positioned after complementary minute digits which correspondingly decrease in value from sixty to thirty. During the second half hour, the principal digit value of the next hour is positioned after principal minute digits which incrementally decrease in value from twenty-nine to one, while simultaneously the complementary digit value of the present hour is positioned before complementary minute digits which correspondingly increase in value from thirty-one to fifty-nine.

If desired a balanced display of seconds, as described in the previous patent application, may be included with the balanced complementary displays of the present invention. This is accomplished by simultaneously displaying second digits which, during an initial part of each minute, incrementally increase in value at the frequency of seconds, and during the subsequent part of the minute decrease in value with the same frequency. It is preferred for maximum balance to divide the minute interval into equal halves, whereby the digit values of seconds will increase from zero to thirty during the first half and decrease from twenty-nine to zero during the second half. It is also preferred that such seconds be displayed below all of the hour and minute digits, and that all digit values of seconds less than ten be displayed with single digits, to minimize distraction from the usually more significant hour and minute time displays needed during general purpose digital timekeeping.

Other features and advantages of the invention will be evident from the following description, taken in connection with the drawings.

DESCRIPTION OF THE PREFERRED EMBODIMENT

Figure 1:
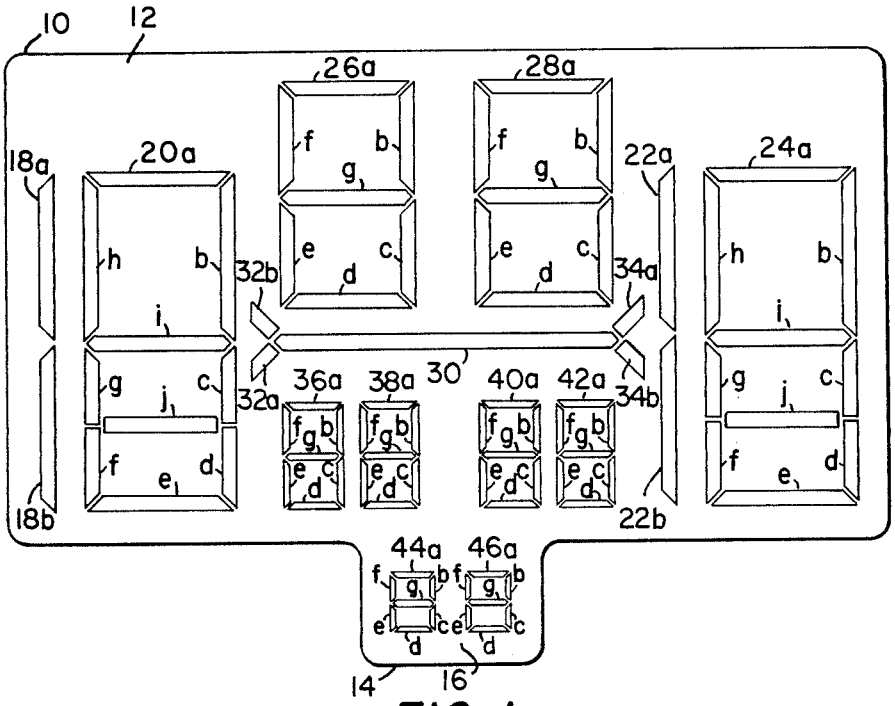
FIG. 1 is a front view of energizable display elements arranged for presenting balanced complementary digital time displays in accordance with a preferred embodiment of the invention.

Referring to FIG. 1, illustrated there is a perimeter 10 defining a horizontally oriented, generally rectangular display background 12. Perimeter 10 has a lower, downwardly projecting portion 14 which outlines a smaller U-shaped extension 16 of the main display background 12.

Background 12 contains a number of display elements which may be selectively operated to become visible to the viewer, e.g. conventional fluorescent, light emitting diode or liquid crystal display elements. Beginning at the extreme left, there are two vertical line elements 18*a* and *b*, which may be operated simultaneously to display the tens unit of a set of relatively tall principal hour digits. Alternatively, the lower element 18*b* may be operated alone to display the tens unit of a set of complementary hour digits having approximately half the height of elements 18*a* and *b* together.

To the right of elements 18*a* and *b* is an array of ten elements 20*a,b,c,d,e,f,g,h,i* and *j*. Of these, horizontal line elements 20*a* and *e* are level with the top and bottom of vertical line elements 18*a* and *b*, respectively, to match the height of the latter when operated simultaneously. Horizontal line element 20*i* is level with the slight space separating the bottom of element 18*a* from the top of element 18*b* to match the height of the latter when operated alone. Element 20*i* also divides the vertical space between elements 20*a* and *e* into approximately equal halves. Horizontal line element 20*j* is positioned approximately midway between elements 20*i* and *e* to divide the vertical space between the latter into approximately equal halves.

The aligned left and right ends of the horizontal elements 20*a,i,j* and *e* are bridged by the sets of vertical line elements 20*h, g* and *f*, and 20*b,c* and *d*, respectively. The adjoining ends of the elements 20*c,d,f,g* and *j* are squared off to form butt joints, thereby maximizing visual continuity between the vertical elements 20*c* and *d*, and 20*g* and *f*, respectively, when operated simultaneously, while maintaining adequate horizontal continuity when element 20*j* is operated together with any one of the elements 20*c,d,f* and *g*. All other joints between adjoining ends of the elements 20*a–j* are mitered.

From the above, it will be evident that elements 20*a,b, c,d,e,f,g,h* and *i* may be selectively operated in combinations to display single digits of any value from 0 to 9 and therefore may be used, together with elements 18*a* and *b*, to display relatively tall principal hour digits of values 1 to 12 in a relatively leading position at the left side of the display background 12. Similarly, elements 20*i,c,d,e,f,g* and *j* may be selectively operated in combinations to display single digits of any value from 0 to 9 and may be used, together with the element 18*b*, to display complementary hour digits of values 1 to 12 having approximately half the height of the above principal hour digits and being in the same relatively leading position in the background 12.

Referring to the right side of background 12, positioned there is another set of vertical line elements 22*a* and *b*, identical to elements 18*a* and *b*, and another array of ten elements 24*a,b,c,d,e,f,g,h,i* and *j*, identical to 20*a–j* inclusive. The elements 22*a* and *b* and 24*a–j* may be selectively operated in the same manner as previously described for elements 18*a* and *b* and 20*a–j* to display, in a relatively trailing position at the right side of background 12, relatively tall principal hour digits from 1 to 12 and complementary hour digits from 1 to 12 having approximately half the height of such principal hour digits.

At the central upper portion of background 12 is a pair of seven-element arrays 26*a–g* and 28*a–g* each array of which may be selectively operated to display single digits of any value from 0 to 9. Operated together, arrays 26*a–g* and 28*a–g* may be used to display principal minute digits ranging in value between 00 and 30, and either trailing the relatively leading principal hour digits provided by elements 18*a* and *b* and 20*a,b,c,d,e,f,g, h* and *i*, or leading the relatively trailing principal hour digits provided by elements 22*a* and *b* and 24*a,b,c,d,e,f,g,h* and *i*. The height of such principal minute digits is less than that of such principal hour digits so that the viewer may readily distinguish the respective time significances thereof.

A horizontal line display element 30 is positioned below the arrays 26*a–g* and 28*a–g*. A substantially shorter line element 32*a* slopes upwardly from left to right to nearly join the left end of element 30, the joint in between being mitered to achieve maximum visual continuity. Another short line element of equal length 32*b* slopes downwardly from left to right to adjoin the left end of element 30 with similar mitering. At the right end of element 30, short line elements 34*a* and *b*, equal in length to elements 32*a* and *b*, and sloping upwardly and downwardly, respectively, away from the right end of element 30 are also provided, with similar mitering between the adjoining ends for enhanced visual continuity.

Below line element 30 are two pairs of seven-element arrays, the first consisting of elements 36*a–g* and 38*a–g*, and the second, elements 40*a–g* and 42*a–g*. Arrays 36*a–g* and 38*a–g* are aligned generally below the seven-element array 26*a–g*, and arrays 40*a–g* and 42*a–g* are similarly aligned below the seven-element array 28*a–g*. Arrays 36*a–g* and 38*a–g* may be operated selectively in combinations to display complementary minute digit values trailing the complementary hour digit values displayed by elements 18*b* and 20*i,c,d,e,f,g* and *j*, the height of such complementary minute digits being less than that of such complementary hour digits in order to distinguish the time significances thereof. Similarly, arrays 40*a–g* and 42*a–g* may be operated to display complementary minute digits leading the complementary hour digits displayed by elements 22*b* and 24*i,c, d,e,f,g* and *j*.

Within the lower U-shaped background extension 16 is a last pair of seven-element arrays 44*a–g* and 46*a–g*. These arrays may be operated selectively in combinations to display digit values of seconds ranging preferably from zero to thirty during the first half of each minute and from twenty-nine to zero during the second half of each minute.

As previously mentioned, it is preferred that all digit values of seconds less than ten be displayed with single digits. Conversely, it is also preferred that all digit values of minutes, both principal and complementary, be displayed with double digits including leading zero digits, in order to achieve maximum visual balance within the displays of hours and minutes while at the same time presenting maximum contrast between those displays and the display of seconds.

These objectives and other advantages are gained also by the size distinctions presented in the various displays, that is, the order of maximum to minimum heights of the respective displayed digits is principal hours, principal minutes, complementary hours, complementary minutes and, lastly, seconds which also are at a level below all of the hour and minute digits. This stepping down of heights and levels, in direct correspondence with the time magnitudes and principal-complementary relationships represented by the respective digits, enables the various appearances presented by the displays over the course of each hour to be immediately comprehended without confusion or ambiguity, as will be evident from the further description below.

Figure 2:
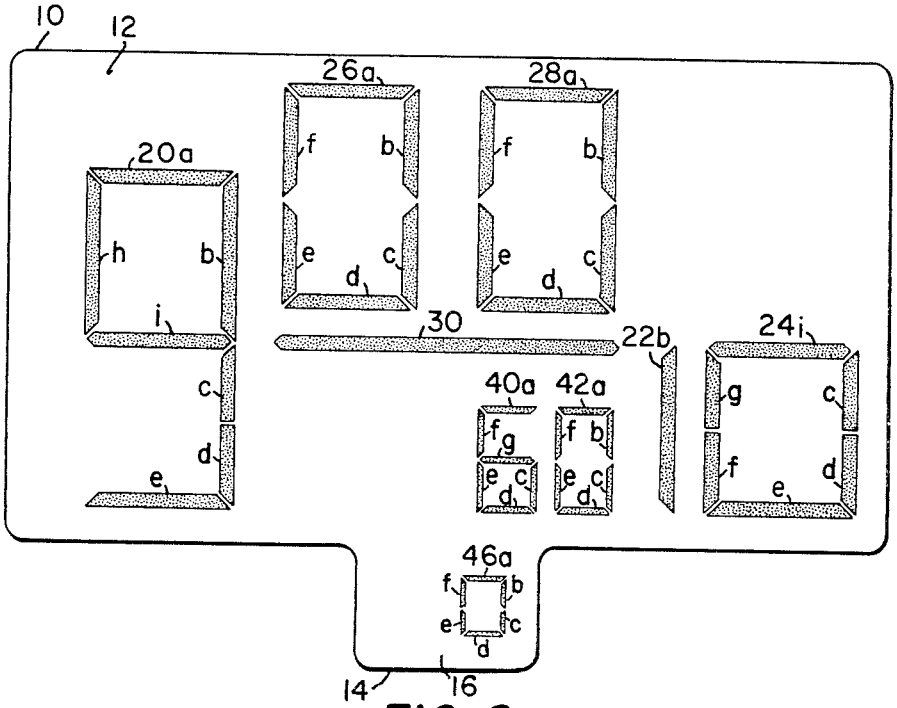
FIG. 2 is a similar view showing the display in operation at the start of an hour.

Referring to FIG. 2, illustrated there is the arrangement of FIG. 1 in operation exactly at the start of the ninth hour (A.M. or P.M.), the various reference numerals identifying those of the elements of FIG. 1 which have been energized to become visible to the viewer. Principal hour digit 9 at the left leads the trailing principal minute digits 00 above horizontal line 30 to inform the viewer that the present time is the beginning of the ninth hour. Complementary minute digits 60 below line 30 lead the trailing complementary hour digits 10 at the right to inform the viewer that the present time also is sixty minutes, or the full hour, before the next hour. The lowermost single zero seconds digit indicates that less than one second of the ninth hour has transpired.

It will be noted that the principal hour and minute digits are the largest and occupy a noticeably predominant segment of the main display background 12. The complementary minute and hour digits are visibly smaller and in a position displaced into the trailing lower right corner of the background, which indicates that the complementary display is defining the forwardly projected time period and hour next forthcoming. These factors also serve to direct the viewer's attention primarily to the principal hour and minutes display, which will usually be of greatest interest during general purpose time-keeping. The time information represented by the complementary minutes and hour display, which may have varying degrees of importance or significance in differing circumstances, is also provided with secondary emphasis and in a format which cannot be confused with the principal display. Thus, each of the respective hour-minute displays, and the principal-complementary time relationship between them, are readily comprehended.

Figure 3:
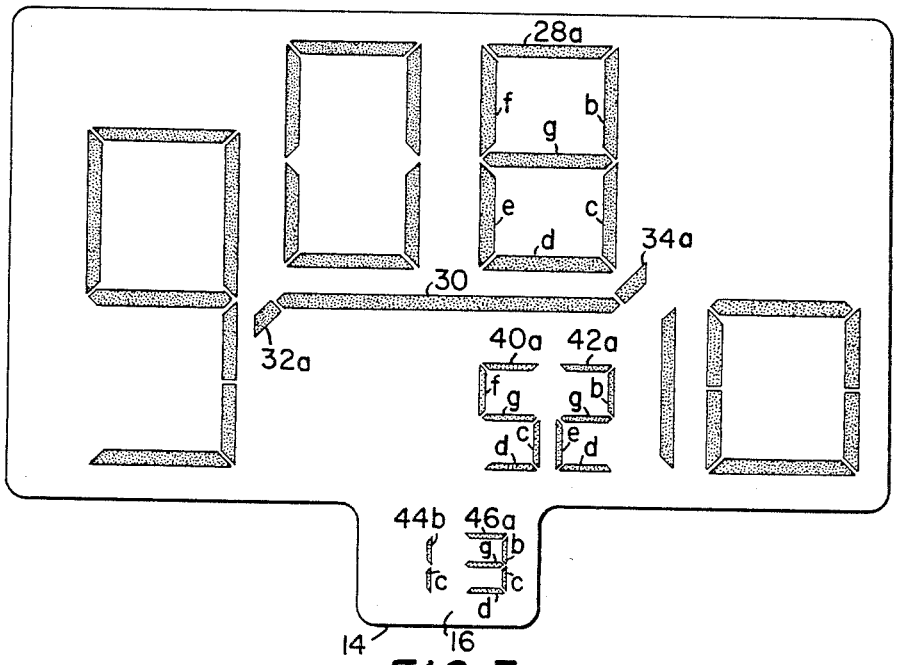
FIG. 3 shows a representative display of operations during the first twenty-nine minutes after the start of the hour.

FIG. 3 shows the FIG. 1 arrangement in operation at eight minutes after the ninth hour, with thirteen seconds of that minute either having elapsed or remaining, depending upon the immediately preceding value of seconds. If that value was twelve, then the viewer is informed that the present time is within the first half of the eighth minute (and also exactly thirteen seconds thereafter), since seconds are increasing toward the half minute point signified by the peak value of thirty. Conversely, if the immediately preceding value was fourteen, the viewer is informed that the present time is within the second half of the eighth minute (with exactly thirteen seconds thereof remaining), since seconds are decreasing toward the zero value representing the end of the eighth minute and the start of the next minute.

The FIG. 3 display is representative of the operation of the FIG. 1 arrangement during the first twenty-nine minutes after the ninth (and each successive) hour. As the principal minutes incrementally increase over that range, the complementary minutes correspondingly decrease from sixty to thirty-one to indicate the diminishing amount of time remaining before the next hour. Throughout this part of the hour, the short upwardly sloping line elements 32*a* and 34*a* preferably are made visible in order to achieve two functions. First, an added indication is given that the principal minutes are increasing in value and therefore all principal time readouts are on the rise toward the half hour point. Secondly, the short lines 32*a* and 34*a*, in combination with the horizontal line 30, add to the visual sense of separation between the predominantly important principal display and the complementary display which ordinarily will be of only secondary interest, particularly when less than half of the present hour has transpired.

Figure 4:
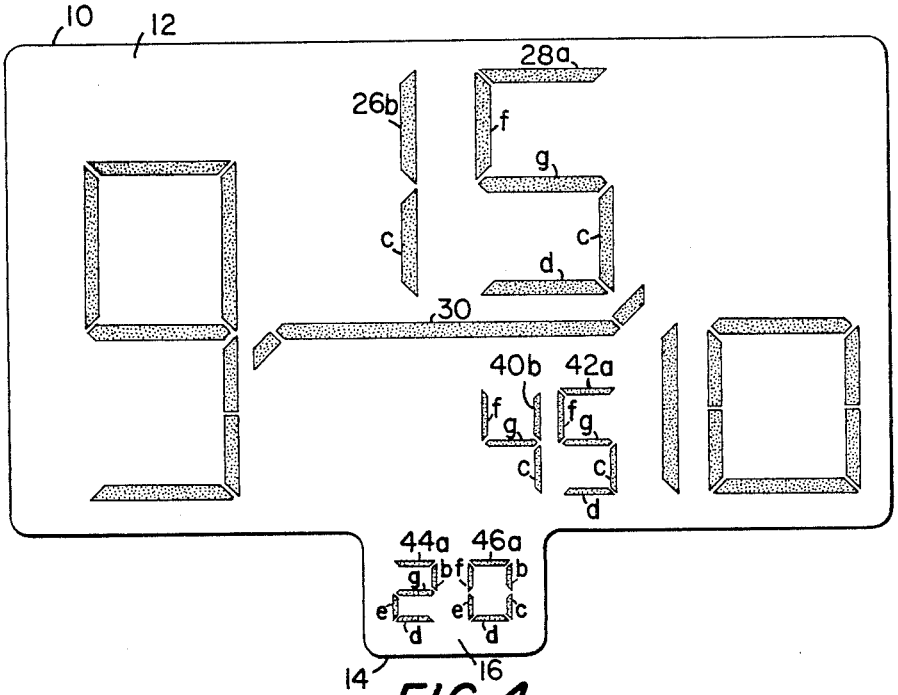
FIG. 4 shows the display in operation specifically at the first quarter of the hour.

FIG. 4 shows the arrangement of FIG. 1 in operation at fifteen minutes after the hour, with twenty seconds of that minute elapsed or remaining. The passage of the first quarter of an hour is often an important time measure in general purpose timekeeping. The FIG. 4 display clearly indicates this point in time, as well as the complementary information that forty-five minutes or three quarters of the hour remain before the arrival of the next hour.

Figure 5:
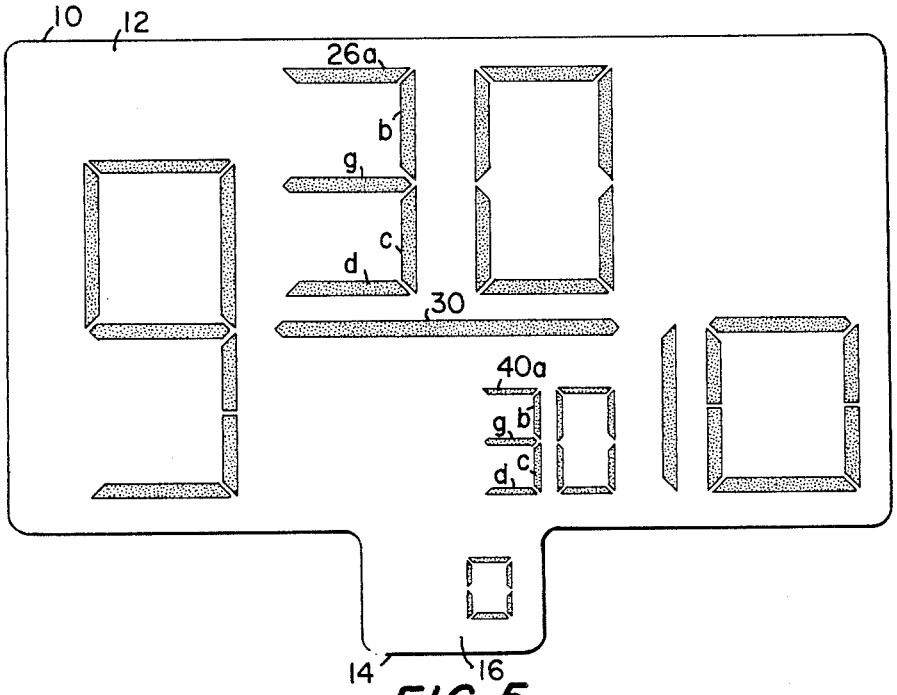
FIG. 5 shows the display in operation specifically at the first half of the hour.

FIG. 5 shows the FIG. 1 arrangement in operation at exactly thirty minutes after the present hour. This is the balance point at which the hour is divided into equal parts. The display clearly indicates this by showing principal minutes of value thirty trailing the principal ninth hour and complementary minutes of equal value leading the complementary next hour. As an added signal of this frequently important point in time, the short upwardly sloping line elements 32*a* and 34*a* preferably are deactivated and blanked from the FIG. 5 display to remove the representation of increasing principal minute digits at the time when no further increase will be observed.

Figure 6:
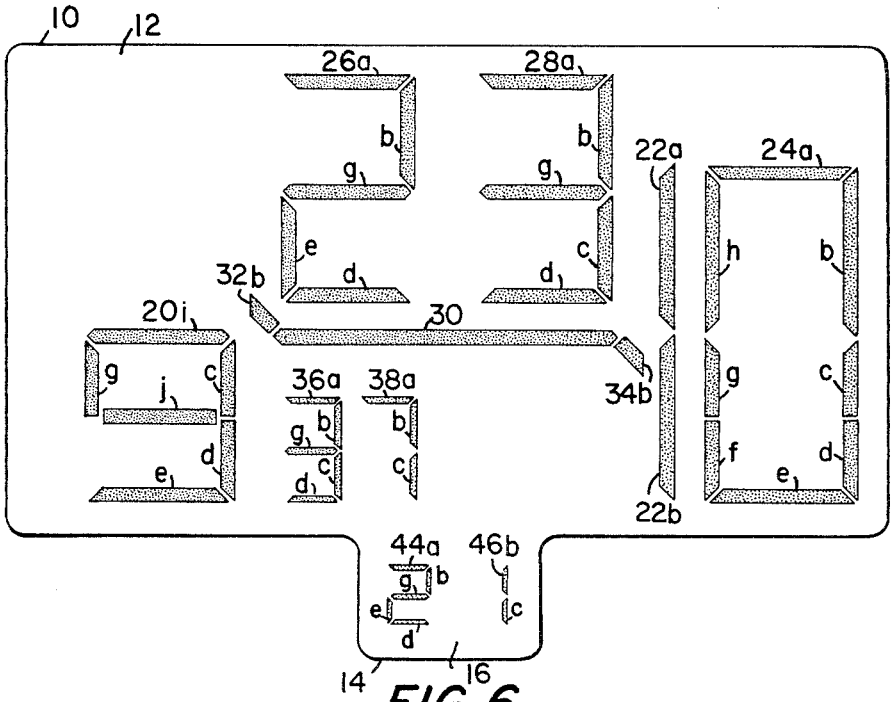
FIG. 6 shows a representative display of operations during thirty-one to fifty-nine minutes after the start of the hour.

FIG. 6 shows a representative display of the FIG. 1 arrangement in operation during the second half hour, commencing with the thirty-first minute after the start of the hour. The principal minute digits 23 lead the principal hour digits 10, indicating that the present time is twenty-three minutes before the arrival of the next hour. Such hour digits have been expanded to twice the height of the complementary hour digits of equal value in FIGS. 2–4, making it evident that the higher digits are now part of the principal time display.

The complementary time display in FIG. 6 further informs the viewer that the present time is also thirty-seven minutes past the ninth or present hour. Such complementary hour digit conversely has been reduced to half the height of the principal hour digit of equal value in FIGS. 2–5 to indicate that the smaller digit is now part of the complementary display. Also, the short downwardly sloping line elements 32*b* and 34*b* are preferably activated, in association with horizontal line 30, to heighten the sense of separation between the principal and complementary displays, as before, and to give an added indication that the principal minute digit values are now decreasing. This reinforces the viewer's comprehension that all principal time readouts in this format are diminishing toward arrival of the next hour.

It should also be noted that the above-described changes in the contents and meanings of the display during the second half of the hour are achieved with retention of the leading and trailing positions of the present and next hour digits at the left and right sides of the display, respectively, regardless of their varying principal-complementary appearances, functions and significances. This feature further contributes to comprehendibility, for the viewer is assured that the first seen hour digit always will be the present hour and ahead of the approaching next hour, in step with the flow of time.

Figure 7:
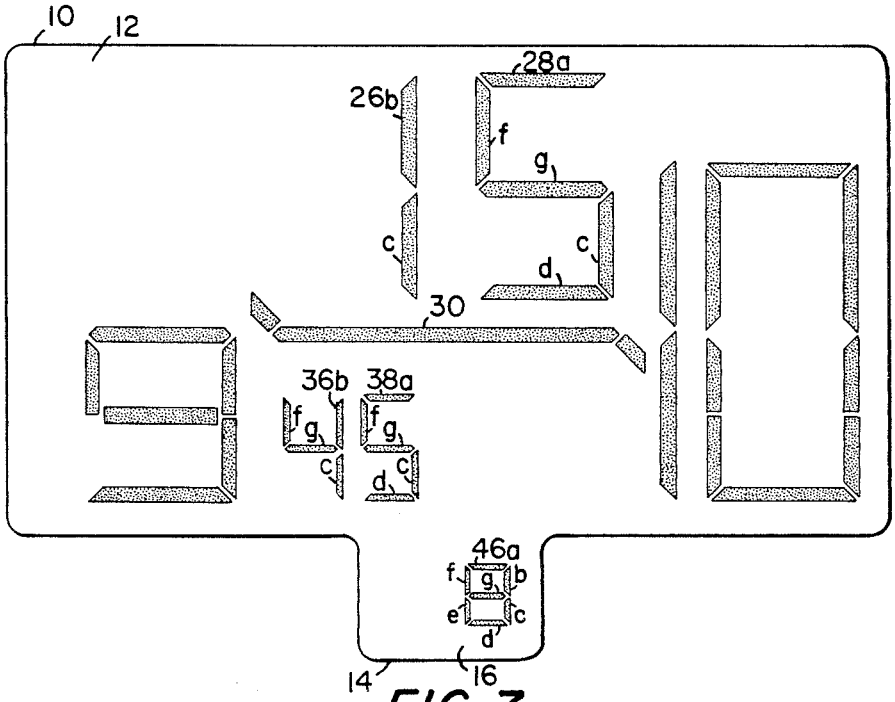
FIG. 7 shows the display in operation specifically at the third quarter of the hour.

Referring to FIG. 7, illustrated there is the FIG. 1 arrangement in operation at the third quarter of the hour, with eight seconds of the current minute either elapsed or remaining. The principal display indicates the present time is fifteen minutes before the tenth hour, while the complementary display shows that the present time is also forty-five minutes past the ninth hour. Although the principal minute digits in this display have been chosen for the purpose of illustration to be identical to those shown in FIG. 4, the opposite significances of such minute digits in such respective displays cannot be confused due to the differences in the sizes and positions of the other digits, and the balance that is incorporated in the respective displays, both internally and in relation to each other. This is also true with respect to all other principal minute digit values ranging from one to twenty-nine, each of which is used twice during the first and second half hours to indicate increasing and decreasing minutes, respectively.

Figure 8:
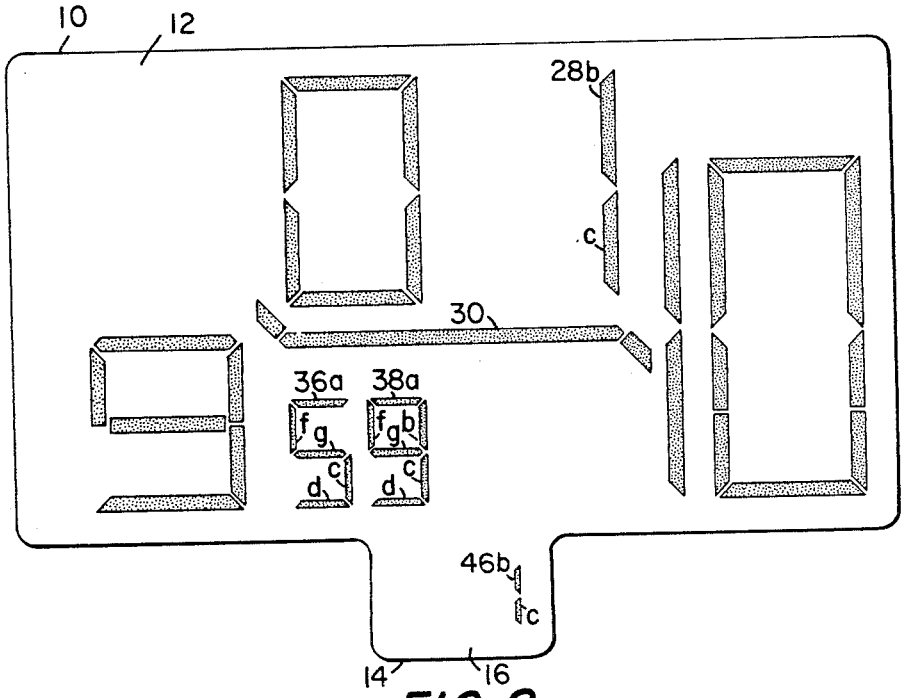
FIG. 8 shows the display in operation specifically at fifty-nine minutes after the start of the hour.

Referring to FIG. 8, illustrated there is the arrangement of FIG. 1 in operation at one minute before the next hour and with one second of the minute remaining, the immediately preceding value of seconds having been two. The complementary display indicates that the present time is also the fifty-ninth minute after the start of the present hour, again with one second remaining. Accordingly, FIG. 8 illustrates the appearance of the display as it operates to inform the viewer of the last displayable fraction of time before the arrival of the next hour, which event is illustrated in FIG. 9.

Figure 9:
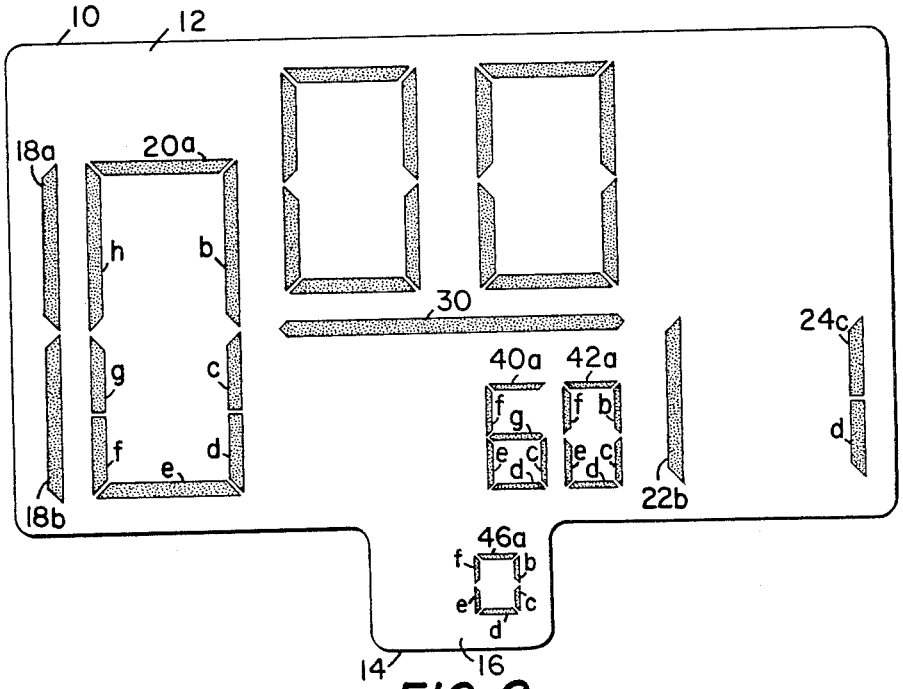
FIG. 9 shows the display in operation at the end of the hour started in FIG. 2 and the beginning of the next hour.

Referring to FIG. 9, the trailing hour digit 10 in FIG. 8 has been transposed, by activation of the cited display element reference numerals, to become the principal present hour digit in the leading position at the left side of background 12, with simultaneous disappearance of the complementary hour digit 9 shown in FIG. 8. At the same time, the trailing hour digit 10 shown in FIG. 8 has disappeared and the complementary hour digit 11 has been activated to appear in the lower trailing position at the right side of the background to indicate the next, sixty-minute-distant hour. Finally, the downwardly sloping line elements 32*b* and 34*b* also have been blanked, so that the display arrangement begins to repeat the cycle described above with respect to the ninth and tenth hours.

The balanced complementary digital time displays of the present invention have been described in terms of their fundamental principles and a preferred illustrative embodiment. Such displays define, with respect to each current exact time readout, the magnitudes of the then expired and remaining parts of the present hour flanking that readout, as well as the then remaining amount of time before the arrival of the next hour. As a result, the viewer is given a complete and useful sense of time from a digital display.

For example, referring to FIG. 3, if at that displayed time the viewer wishes to establish the specific time of another event scheduled for thirty minutes later, two choices are available. The thirty minutes can be added to the displayed principal eight minutes to determine that the future event will occur at thirty-eight minutes past the ninth hour. Alternatively, the thirty minutes can be subtracted from the displayed complementary fifty-two minutes to ascertain that the event also will take place at twenty-two minutes before the tenth hour. The latter provides a more forwardly projected sense of the involved timing since the calculated minutes value is lower and related ahead to the approaching next hour, instead of referencing back to what will be the more distant ninth hour as in the first choice. In either case, FIG. 6 illustrates the display presented to the viewer one minute before the occurrence of the above exemplary future time determination. Since both bases of the alternative forward calculations, minutes expired and minutes remaining in the present hour, are on display, the viewer can use either choice readily to note the imminent occurrence of the involved event. This illustrates, in one major aspect, the greater versatility and facility in use achieved from the display of one's present position in digital time by reference to both of the then subdivided parts of the hour underway as well as the time remaining before the next hour, as compared to the simpler balanced displays of the previous patent application.

It will be evident to those skilled in the art that the illustrative preferred embodiment may be modified in various ways without departing from the fundamental principles of the invention. For example, the two pairs of seven-element arrays 36*a–j*, 38*a–j* and 40*a–j*, 42*a–j* can be replaced by a single pair of larger overall size and height to display complementary minute digit values in a fixed readout position between the hour digits displayed at the left and right sides of the background. This modification can be accompanied by the use of present and next hour digits at the left and right sides which are of equal relatively tall height and which do not change heights as in the preferred embodiment. While such changes may be considered desirable for the purpose of simplification and economy, in that the number of display elements thereby can be reduced, it is believed that the resulting displays will not be preferred by the majority of users. The main reason is that such simpler displays will present fewer of the distinctions between the respective principal-complementary displays of the illustrative embodiment and, therefore, will likely require closer attention, more interpretation and longer familiarization in order to be read and understood properly. Nevertheless, such trade-offs may be considered acceptable in specific applications.

Other alternatives will also occur to those skilled in the art. For example, the display of seconds can be eliminated where the degree of precision is not required or desired. The remaining hour and minute displays will provide all of the other advantages described above. Another alternative is to display at the start of each hour double zero, instead of sixty, complementary minute digits leading the complementary next hour to signify that no part of the hour-long period before the next hour has transpired. A further alternative is to enable the complementary time displays to be activated on demand, rather than continuously, as required or desired by the viewer. The remaining continuously-seen balanced principal time displays will then provide all of the advantages described in the previous patent application. Calendar displays of the day of the week and date of the month of the type disclosed in copending application Ser. No. 919,742, filed June 27, 1978, or other types, may be added to the displays of this invention. All of the digits may be slanted slightly to the right from true perpendicular to present an appearance preferred as more attractive by some. Finally, digits presented or activated by mechanical means, e.g. rotating wheels or tapes, flipover discs or plates, etc., may be used to establish the balanced complementary displays described herein. Generally, all forms of display elements which are operable to display digits in formats, value sequences and readout positions conforming with the principles of the invention may be used.

Accordingly, it will be understood that the invention is not limited to the illustrative preferred embodiment but encompasses the subject matter delineated by the appended claims and all equivalents thereof. For purposes of clarity, it should also be understood that the four horizontal elements of the ten element arrays 20*a–j* and 24*a–j* are identified, when specified in the claims, by the following terminology:

| Element | Claim identification |
|---|---|
| "a" | "uppermost" |
| "i" | "central" |
| "j" | "last" |
| "e" | "lowermost" |

The following is claimed:

1. A balanced complementary digital time display system which comprises:

hour elements (a) operable to display the digit value of a present hour;

minute elements (b) operable to display minute digits which increase in value in a readout position trailing the present hour;

hour elements (c) operable to display the digit value of the next hour; and minute elements (d) operable to display minute digits which decrease in values complementary to the increasing minute digit values and in a readout position leading the next hour, whereby time expired after the present hour may be displayed by elements (a) and (b), together with corresponding time remaining before the next hour displayed by elements (c) and (d).

2. A system as in claim 1 in which the height of the present hour digits is greater than the height of the increasing minute digits and in which the height of the next hour digits is greater than the height of the decreasing minute digits.

3. A system as in claim 1 in which the present hour digits are in a readout position leading the next hour digits.

4. A system as in claim 1 in which the increasing minute digits are in a readout position above the level of the decreasing minute digits.

5. A system as in claim 4 which further includes a horizontal line display element operable to display a horizontal line between the increasing and decreasing minute digits.

6. A system as in claim 1,2,3,4 or 5 which further includes second elements operable to display digit values of seconds which increase from zero to thirty during the first half of each present minute and which decrease from twenty-nine to zero during the second half of the same minute.

7. A system in claim 6 in which the digit values of seconds are displayed in a readout position below the level of all of the hour and minute digits.

8. A balanced complementary digital time display system which comprises:

hour elements (a) operable to display principal hour digit values which indicate the present hour and the next hour, respectively, during initial and subsequent parts of a present hour;

minute elements (b) operable to display principal minute digits which increase in value in a readout position trailing the principal present hour and which decrease in value in a readout position leading the principal next hour;

hour elements (c) operable to display complementary hour digit values which indicate the next hour and the present hour, respectively, during the initial and subsequent parts of the present hour; and minute elements (d) operable to display complementary minute digits which decrease in value in a readout position leading the complementary next hour and which increase in value in a readout position trailing the complementary present hour;

whereby during the initial part of the present hour, time expired after the present hour may be displayed by the increasing principal minutes (b) trailing the principal present hour (a), together with corresponding time remaining before the next hour displayed by the correspondingly decreasing complementary minutes (d) leading the complementary next hour (c) and, during the subsequent part of the present hour, time remaining before the next hour may be displayed by the decreasing principal minutes (b) leading the principal next hour (a), together with corresponding time expired after the present hour displayed by the correspondingly increasing complementary minutes (d) trailing the complementary present hour (c).

9. A system as in claim 8 in which the heights of the respective hour and minute digits are different from each other and in a maximum to minimum order of principal hours, principal minutes, complementary hours and complementary minutes.

10. A system as in claim 8 or 9 which further includes second elements operable to display digit values of seconds which increase from zero to thirty during the first half of each present minute and which decrease from twenty-nine to zero during the second half of the same minute.

11. A system as in claim 10 in which the height of the digits displaying seconds is less than that of all of the hour and minute digits.

12. A balanced complementary digital time display system which comprises:

a display background (a) within which digital time values may be presented for readout in a left to right direction;

at approximately the left side of the background, two vertical line elements (b) which may be operated simultaneously to display the tens unit of relatively tall principal hour digits and the lower one of which may be operated alone to display the tens unit of complementary hour digits having approximately half the height of the relatively tall principal hour digits;

to the right of the elements (b), a ten-element array of line display elements (c) arranged in positions of uppermost and lowermost horizontal elements, a central horizontal element approximately midway vertically between the uppermost and lowermost horizontal elements, and a last horizontal element approximately midway vertically between the central and lowermost horizontal elements, the left and right ends of the four horizontal elements being bridged respectively by two sets of three vertical line elements; the uppermost, central and lowermost horizontal elements being operable together with all the bridging vertical elements to display relatively tall single principal hour digits of value zero to nine approximately matching the height of the two elements (b) together; and the central, last and lowermost horizontal elements being operable together with the vertical elements bridging the aligned ends thereof to display single complementary hour digits of the same values approximately matching the height of the lower of the elements (b) alone;

at approximately the right side of the background, a duplicate set (d) of elements (b) and (c) of identical components and operability for display of principal and complementary hour digits in a readout position which is trailing relative to hour digits displayed by the elements (b) and (c) at the left side;

at the central portion of the background, between the elements (b) and (c) and the duplicate elements (d), a pair of seven-element arrays of line display elements (e) which may be operated to display principal minute digit values ranging between zero and thirty; and below the element (e), and also between the elements (b) and (c) and the duplicate elements (d), at least one pair of seven-element arrays of line display elements (f) which may be operated to display complementary minute digit values ranging between sixty and thirty;

whereby the respective elements may be operated so that (i) during the first half of each present hour, elements (b) and (c) display the principal digit value of the present hour and elements (e) display principal digit values of minutes increasing from zero to thirty to indicate time expired after such hour, while elements (d) display the complementary digit value of the next hour and elements (f) display complementary digit values of minutes correspondingly decreasing from sixty to thirty to indicate corresponding time remaining before the next hour, and (ii) during the second half of each present hour, elements (d) display the principal digit value of the next hour and elements (e) display principal digit values of minutes decreasing from twenty-nine to one to indicate time remaining before the next hour, while elements (b) and (c) display the complementary digit value of the present hour and elements (f) display complementary digit values of minutes correspondingly increasing from thirty-one to fifty-nine to indicate corresponding time expired after the present hour.

13. A system as in claim 12 in which elements (f) comprise two pairs of seven-element arrays of line display elements, one pair being operable to display increasing complementary minute digit values to the right of the complementary hour digits displayed by elements (b) and (c), and the other pair being operable to display decreasing complementary minute digit values to the left of the complementary hour digits displayed by the duplicate elements (d).

14. A system as in claim 12 which further includes a downwardly projecting U-shaped extension of the display background, a pair of seven-element arrays of line display elements within the extension operable to display digit values of seconds which increase from zero to thirty during the first half of each present minute and which decrease from twenty-nine to zero during the second half of the same minute.

15. A system as in claim 14 in which the heights of all of the displayed digits are different from each other and in a maximum to minimum order of principal hours, principal minutes, complementary hours, complementary minutes and seconds.

16. A system as in claim 12, 13, 14 or 15 which further includes a horizontal line element below the elements (e) which may be operated to display a horizontal line between the principal and complementary minute digits.

17. A system as in claim 16 which further includes at the left end of the horizontal line element, two adjoining substantially shorter line display elements, one sloping upwardly left to right from below to the horizontal line and the other sloping downwardly left to right from above to the horizontal line, respectively, and at the right end of the horizontal line element, two additional adjoining substantially shorter line display elements, one sloping upwardly left to right away from the horizontal line and the other sloping downwardly left to right away from the horizontal line, whereby during the first twenty-nine minutes of each present hour, the left and right upwardly sloping line elements may be displayed together with the horizontal line to signify that all principal time readouts are rising toward the half hour point and, during the last twenty-nine minutes of each present hour, the left and right downwardly sloping line elements may be displayed together with the horizontal line to signify that all principal time readouts are diminishing toward the next hour.

18. An array for display of digits of different heights which comprises:

(a) four horizontal line display elements arranged in positions of uppermost and lowermost horizontal elements, a central horizontal element approximately midway vertically between the uppermost and lowermost horizontal elements, and a last horizontal element approximately midway vertically between the central and lowermost horizontal elements, the left and right ends of the horizontal elements being in approximate vertical alignment; and (b) two sets of three vertical line display elements bridging, respectively, the aligned left and right ends of the horizontal elements, whereby (i) the uppermost, central and lowermost horizontal elements together with all the bridging vertical elements may be selectively operated to display relatively tall digits of value zero to nine, and (ii) the central, last and lowermost horizontal elements together with the vertical elements bridging the left and right ends thereof may be selectively operated to display digits of equal value having approximately half the height of the relatively tall digits.

19. An array as in claim 18 in which the left and right ends of the last horizontal element and the ends of the bridging vertical elements adjoining thereto are configured as butt joints.

20. An array as in claim 18 in which the left and right ends of the uppermost, central and lowermost horizontal elements and the ends of the bridging vertical elements adjoining thereto are configured as mitered joints.

21. An array as in claim 18 which further includes two vertical line display elements adjacent the left side of the array, which two elements may be operated simultaneously to display a tens unit value in combination with the relatively tall digits and the lower one of which may be operated alone to display a tens unit value in combination with the digits having approximately half the height of the relatively tall digits.

22. A balanced complementary digital timekeeping method which comprises:

(a) displaying the digit value of a present hour and increasing minute digit values in a readout position trailing the present hour to indicate time expired after the present hour, together with (b) displaying the digit value of the next hour and decreasing minute digit values complementary to the increasing minute digit values and in a readout position leading the next hour to indicate corresponding time remaining before the next hour.

23. A method as in claim 22 which further includes the steps of displaying the present hour digits in a height greater than that of the increasing minute digits and displaying the next hour digits in a height greater than that of the decreasing minute digits.

24. A method as in claim 22 which further includes the step of displaying the present hour digits in a readout position leading the next hour digits.

25. A method as in claim 22 which further includes the step of displaying the increasing minute digits in a readout position above the level of the decreasing minute digits.

26. A method as in claim 25 which further includes the step of displaying a horizontal line between the increasing and decreasing minute digits.

27. A method as in claim 22, 23, 24, 25 or 26 which further includes the steps of displaying digit values of seconds increasing in value from zero to thirty during the first half of each present minute and decreasing in value from twenty-nine to zero during the second half of the same minute.

28. A method as in claim 27 which further includes the step of displaying the digit values of seconds in a readout position below the level of all of the hour and minute digits.

29. A balanced complementary digital timekeeping method which comprises:

(a) during an initial part of a present hour displaying (i) the principal digit value of the present hour and increasing principal minute digit values in a readout position trailing the principal present hour to indicate time expired after the present hour, together with (ii) the complementary digit value of the next hour and correspondingly decreasing complementary minute digit values in a readout position leading the complementary next hour to indicate corresponding time remaining before the next hour, and (b) during the subsequent part of the present hour displaying (i) the principal digit value of the next hour and decreasing principal minute digit values in a readout position leading the principal next hour to indicate time remaining before the next hour, together with (ii) the complementary digit value of the present hour and correspondingly increasing complementary minute digit values in a readout position trailing the complementary present hour to indicate corresponding time expired after the present hour.

30. A method as in claim 29 which further includes the step of displaying the hour and minute digits in heights differing from each other in a maximum to minimum order of principal hours, principal minutes, complementary hours and complementary minutes.

31. A method as in claim 29 which further includes the steps of displaying digit values of seconds increasing from zero to thirty during the first half of each present minute and decreasing from twenty-nine to zero during the second half of the same minute.

32. A method as in claim 31 which includes the further steps of displaying all digit values of seconds less than ten with single digits.

33. A balanced complementary digital timekeeping method which comprises:

(a) during the first half of each present hour displaying
  (i) the principal digit value of the present hour and principal minute digit values increasing from one to thirty in a readout position trailing the principal present hour, together with
  (ii) the complementary digit value of the next hour and complementary minute digit values correspondingly decreasing from fifty-nine to thirty in a readout position leading the complementary next hour, and (b) during the second half of each present hour displaying
  (i) the principal digit value of the next hour and principal minute digit values decreasing from twenty-nine to one in a readout position leading the principal next hour, together with
  (ii) the complementary digit value of the present hour and complementary minute digit values correspondingly increasing from thirty-one to fifty-nine in a readout position trailing the complementary present hour, whereby during the first half of each hour, the principal hour-minutes display indicates time expired after the present hour while the complementary hour-minutes display indicates corresponding time remaining before the next hour, and during the second half of each hour, the principal hour-minutes display indicates time remaining before the next hour and the complementary hour-minutes display indicates corresponding time expired after the present hour.

34. A method as in claim 33 which further includes the steps of displaying, at the commencement of each hour, double zero principal minute digits in a readout position trailing the principal present hour and complementary minute digits of value sixty in a readout position leading the complementary next hour.

35. A method as in claim 33 which further includes the steps of displaying the hour and minute digits in heights differing from each other in a maximum to minimum order of principal hours, principal minutes, complementary hours and complementary minutes.

36. A method as in claim 33 which further includes the steps of displaying digit values of seconds increasing from zero to thirty during the first half of each minute and decreasing from twenty-nine to zero during the second half of the same minute.

37. A method as in claim 36 which further includes the steps of displaying the digit values of seconds in a readout position below the level of all of the hour and minute digits, and displaying all digit values of seconds less than ten with single digits.

38. A method as in claim 36 which further includes the step of displaying the seconds digits in a height less than that of all of the hour and minute digits.

39. A method as in claim 33 which further includes the step of displaying the complementary hour digits in a height approximately half that of the principal hour digits.

40. A method as in claim 33 which further includes the step of displaying a horizontal line between the principal and complementary minute digits.

41. A method as in claim 40 which further includes the steps of displaying during the first twenty-nine minutes of each hour substantially shorter lines sloping upwardly from left to right to adjoin to and away from the left and right ends, respectively, of the horizontal line and thereby signify that all principal time readouts are rising toward the half hour point, and displaying during the last twenty-nine minutes of each hour substantially shorter adjoining lines sloping downwardly from left to right to adjoin to and away from the left and right ends, respectively, of the horizontal line and thereby signify that all principal time readouts are diminishing toward the next hour.

42. A method as in claim 33 which further includes the steps of displaying the principal and complementary hour-minute displays simultaneously throughout the period of each hour.

43. A system as in claim 8 in which the initial and subsequent parts of the present hour are its first and second halves.

* * * * *

UNITED STATES PATENT AND TRADEMARK OFFICE

CERTIFICATE OF CORRECTION

PATENT NO. : 4,270,196

DATED : May 26, 1981

INVENTOR(S) : Berj A. Terzian

It is certified that error appears in the above-identified patent and that said Letters Patent are hereby corrected as shown below:

Column 9, line 39: Delete "the" and substitute --that--.

Column 12, line 15: Change "element" in the first instance to --elements--.

Signed and Sealed this

*Eleventh* Day of *August 1981*

[SEAL]

*Attest:*

GERALD J. MOSSINGHOFF

*Attesting Officer*

*Commissioner of Patents and Trademarks*